US005478388A

United States Patent [19]

Gane et al.

[11] Patent Number: 5,478,388

[45] Date of Patent: Dec. 26, 1995

[54] PIGMENT FOR A COATING COMPOSITION FOR PRINTING PAPER

[75] Inventors: Patrick A. C. Gane, Callington; Philip M. McGenity, St. Austell, both of United Kingdom

[73] Assignee: ECC International Limited, United Kingdom

[21] Appl. No.: 234,270

[22] Filed: Apr. 28, 1994

[30] Foreign Application Priority Data

May 4, 1993 [GB] United Kingdom ..... 9309150

[51] Int. Cl.[6] ..... D21H 19/40; C09D 5/00

[52] U.S. Cl. ..... 106/415; 106/416; 106/464; 106/469; 106/20 R; 106/23 C

[58] Field of Search ..... 106/464, 469, 106/415, 416, 20 R, 23 C

[56] References Cited

U.S. PATENT DOCUMENTS 5,120,365 6/1992 Kogler ..... 106/415

FOREIGN PATENT DOCUMENTS 0332102 9/1989 European Pat. Off. .
2468688 5/1981 France .
4153397 5/1992 Japan .
1317563 5/1973 United Kingdom .
2224673 5/1990 United Kingdom .
2250296 6/1992 United Kingdom .
WO92/09746 6/1992 WIPO .
WO93/20019 10/1993 WIPO .

OTHER PUBLICATIONS

"Techniques for Electron Microscopy" edited by D. H. Kay, Blackwell Scientific Publications Limited, Oxford, 1968, pp. 136–144 (No Month Availaible).

Product Specification entitled "China Clays for the Paper Industry NP 50", Undated.

P. M. McGenity, "High Speed Runnability of Blade Coaters", Paper Technology, Apr. 1992, pp. 14–18.

P. A. C. Gene et al., "Factors Influencing the Runnability of Coating Colours at High Speed", Tappi Journal, vol. 75, No. 5, May 1992, pp. 61–73.

*Primary Examiner*—Mark L. Bell
*Assistant Examiner*—Scott L. Hertzog
*Attorney, Agent, or Firm*—Klauber & Jackson

[57] ABSTRACT

There is disclosed a paper coating pigment comprising:

(a) from 10% to 100% by weight of a first paper coating pigment having a particle size distribution such that at least 75% by weight of the particles have an equivalent spherical diameter smaller than 2 μm and at least 60% by weight have an equivalent spherical diameter smaller than 1 μm, the average particle aspect ratio of the size fraction having an equivalent spherical diameter predominantly smaller than 1 μm being 25 or greater; and (b) up to 90% by weight of a second paper coating pigment.

17 Claims, No Drawings

PIGMENT FOR A COATING COMPOSITION FOR PRINTING PAPER

This invention concerns an improved kaolinitic clay pigment for use in a coating composition for preparing coated papers which are especially suitable for printing by the offset or rotogravure processes. Herein, the term "paper" is used to describe any fibrous web having a surface which receives a coating composition, and includes materials such as board.

Coated papers for use in printing may be prepared by a number of different coating processes. However, when the coated paper is required to be prepared by coating a web of paper at high speed the coating apparatus generally includes a blade in the trailing orientation relative to the web, in other words such that it makes an acute angle with the web on the upstream side of the blade. The purpose of this blade is to act as a "doctor" which removes surplus coating composition leaving a smooth and level coating of the required coat weight over the whole width of the web.

Two especially commonly used types of paper coating apparatus are the roll applicator coater and the short-dwell coater. In the roll applicator coater the web of uncoated paper passes through the nip between two rolls, one of which is partially immersed in a bath of the coating composition, and thus transfers coating composition on to one side of the web. The web then passes, coated side outwards, around a backing roll, which is preferably covered with a sleeve of resilient material, and a trailing blade is biased against the web supported by the backing roll, at a pressure such as to give the desired coat weight. The trailing blade is generally mounted at a distance of from about 200 mm to about 1000 mm downstream of the roll applicator. Now, increasing use is being made of coating apparatus of the short-dwell type. In this type of apparatus the coating composition is fed under a small positive pressure to a chamber which is a few centimeters in width, one wall of which is formed by a blade in a trailing orientation with respect to the web, and another wall of which is formed by the web. With this type of apparatus a very much shorter time elapses between the application of the coating composition to the paper and the removal of excess coating by the trailing blade.

There is a trend in the paper coating industry to run coating machines at increasingly faster speeds. When the first trailing blade coater was introduced in 1955, the maximum speed of the web was about 600 $m.min^{-1}$. Today commercial coating machines can run at a web speed of 1500 $m.min^{-1}$ and pilot coating machines at speeds in excess of 2000 $m.min^{-1}$.

As coating machines have been operated at faster web speeds, a problem has become apparent which is known as "bleeding" of the coating composition, or, alternatively, the formation of "stalagmites" on the downstream edge of the blade. This problem manifests itself in the building up at the blade edge of deposits of coating composition which have a form which is suggestive of stalagmites. These deposits tend to cause localised deposition of excess coating composition on to the web to form streaks or spots, where the coating is thicker than desired, or localised areas where the coating is thinner than desired, or absent altogether, which manifest themselves as "scratches". These defects in the coating are not only unsightly but, in the case of the raised streaks or spots, can cause damage to parts of the coating apparatus downstream of the blade, for example the supercalender rolls.

One theory which has been proposed to explain the formation of stalagmites suggests that, under certain circumstances, film splitting of the coating composition occurs at the blade. Normally the coating composition passes through the gap between the blade and the web either in shear flow or under plug flow. In other words, the composition separates from, and slips past, the edge of the blade at a velocity close to that of the web. Under certain circumstances the velocity of the film of composition at the blade edge can be reduced to zero, with the result that a steep velocity gradient exists between the web and the blade which results in splitting of the film, and an accumulation of coating composition on the downstream edge of the blade.

The condition of zero velocity of the film of coating composition at the blade edge is rendered less likely if excess coating composition can flow relatively easily along the upstream surface of the blade. The onset of the conditions under which stalagmite formation occurs has been found to depend on the solids content and nature of the coating composition, the speed of the web, the angle of the blade and the desired coat weight. Generally, the onset of stalagmite formation becomes more likely as the solids content of the coating composition and/or the web speed are increased or as the angle of the blade is decreased. It can be seen that all three of these changes are likely to hinder the smooth flow of excess coating composition in the region upstream of the blade. The coat weight is controlled by adjusting the pressure under which the blade is biased against the moving paper web. This is advantageously achieved either by providing in contact with the blade a tube of resilient material to the interior of which is supplied a fluid at an elevated pressure, or by flexing the blade about a fulcrum placed in a similar position to that of the tube. Generally the higher the pressure of the fluid in the resilient tube, or the greater the flexure of the blade, the more strongly will the blade be biased against the web, the smaller will be the gap which opens between the blade and the web when the coating machine is in use, and the lighter will be the coat weight. In practice it is found that there is only a relatively narrow range for the blade pressure, which may be, for example, between 1 and 2 bar, in the case of the resilient tube, although these parameters may vary considerably depending on parameters specific to a given coating operation. It is generally found that if the pressure is above a certain upper limit, which may be, for example, 2 bar, the blade is so strongly biased against the web that breakage of a lightweight web and/or excessive abrasion of the blade tends to occur, whereas, if the pressure is below a certain lower limit, which may be, for example, 1 bar, it is difficult to maintain a constant uniform coat weight. In order to achieve a relatively high coat weight, for example of 8 $g.m^{-2}$, it is generally necessary to use a composition having a high solids content, but this tends to increase the risk of stalagmite formation. It is generally found to be difficult to achieve a high coat weight at a high web speed and using a coating composition of high solids content without experiencing stalagmite formation.

A further factor which influences the conditions under which stalagmite formation begins is the degree to which water is transferred from the coating composition into the paper web. When the coating composition is applied by means of a roll applicator a pressure pulse is applied in the nip of the roll acting on the coating composition and on the web. The action of the pressure pulse is to initiate water loss from the coating composition into the paper web. The time taken for a given small area of coating on the web to pass from the point of application to the blade is longer than in the case of the short-dwell coater, and there is therefore more scope for water to be absorbed from the coating composition into the web, with a consequent further increase in the solids content of the composition remaining on the web. A second pressure pulse is then applied in a similar manner at the trailing blade, thus causing yet further water loss. Also, many users of roll applicator coating machines add to the coating composition a viscosifying agent which ensures that an adequate quantity of coating composition is transferred by the applicator roll from the bath of composition to the web. The viscosifying agent is generally a hydrophilic polymer such as starch or sodium carboxymethyl cellulose. These factors, either separately or in combination, have been found to render the incidence of stalagmite formation more likely.

Although a much shorter time is available for the absorption of water from the coating composition into the paper web to take place in the case of a short-dwell coating machine, the pressure pulse at the trailing blade remains and contributes significantly to the loss of water, and the extent to which this occurs has been found to depend inter alia on the nature of the pigment contained in the coating composition.

The paper "High speed runnability of blade coaters" by Philip M. McGenity, Paper Technology, April 1992, pages 14–18 discusses the effect of the size and shape of the particles in the paper coating pigment on the degree to which water is absorbed from a coating composition into the paper web in a blade coating machine.

The influence of particle shape is further exemplified in the paper "Factors influencing the runnability of coating colours at high speed", by P. A. C. Gane, P. M. McGenity and P. Watters, TAPPI Journal, Vol. 75, No. 5, May 1992, pages 61–73.

According to a first aspect of the present invention there is provided a paper coating pigment comprising:

(a) from 10% to 100% by weight of a first paper coating pigment having a particle size distribution such that at least 75% by weight of the particles have an equivalent spherical diameter smaller than 2 μm and at least 60% by weight have an equivalent spherical diameter smaller than 1 μm, the average particle aspect ratio of the size fraction having an equivalent spherical diameter predominantly smaller than 1 μm being 25 or greater; and (b) up to 90% by weight of a second paper coating pigment.

Preferably the average particle aspect ratio of the size fraction of the first paper coating pigment having an equivalent spherical diameter predominantly smaller than 1 μm is 30 or greater, more preferably 40 or greater.

Preferably, the first paper coating pigment constitutes at least 20% by weight of the total pigment and more preferably at least 40% by weight of the total pigment.

The first paper coating pigment (which may be a mixture of pigments) is advantageously a kaolinitic clay, but other inorganic materials such as talc, ground natural calcium carbonate, precipitated calcium carbonate, natural calcium sulphate, such as gypsum, or synthetic calcium sulphate may be used, provided that it meets the above aspect ratio requirement. The second paper coating pigment (which may be a mixture of pigments) may be any pigment suitable for use in paper coating such as a kaolinitic clay, talc, ground natural calcium carbonate, precipitated calcium carbonate, natural calcium sulphate, such as gypsum, or synthetic calcium sulphate.

When the first paper coating pigment of the above type is used in the paper coating composition it is found to enhance the water retention of the paper coating composition (as manifested in a smaller increase in solids concentration with running time in the coating composition), and to make it possible to achieve relatively high coat weights (for example at least 7 $gm^{-2}$ over a wide range of web speeds without having to operate at excessively high or low blade pressures and without the formation of stalagmites.

In a preferred embodiment of the first aspect of the present invention, the paper coating pigment as a whole has the following characteristics:

a particle size distribution such that at least 45% by weight of the particles have an equivalent spherical diameter smaller than 2 μm; and a distribution of particle aspect ratios such that if the pigment is subjected to a particle size separation such that the pigment is divided into a first fraction consisting predominantly of particles having an equivalent spherical diameter larger than 1 μm, and a second fraction consisting predominantly of particles having an equivalent spherical diameter smaller than 1 μm, the average aspect ratio of the first fraction is greater than 25 and the average aspect ratio of the second fraction is greater than 25.

In another preferred embodiment of the first aspect of the present invention, the paper coating pigment as a whole has the following characteristics:

a particle size distribution such that at least 45% by weight of the particles have an equivalent spherical diameter smaller than 2 μm; and a distribution of particle aspect ratios such that each of the following size fractions of the pigment:

≦0.5 μm

>0.5 μm to 1.0 μm

>1.0 μm to 2.0 μm

>2.0 μm to 5.0 μm

>5.0 μm to 10.0 μm

>10.0 μm and which also contains an appreciable proportion of the particles of the pigment has an average aspect ratio of 25 or more.

In a yet further preferred embodiment of the first aspect of the present invention, the paper coating pigment as a whole has the following characteristics:

a particle size distribution such that at least 45% by weight of the particles have an equivalent spherical diameter smaller than 2 μm; and a distribution of particle aspect ratios such that any size fraction of the pigment containing an appreciable proportion of the particles of the pigment has an average aspect ratio of 25 or more.

According to a second aspect of the present invention there is provided a paper coating pigment comprising:

a particle size distribution such that at least 45% by weight of the particles have an equivalent spherical diameter smaller than 2 μm; and a distribution of particle aspect ratios such that if the pigment is subjected to a particle size separation such that the pigment is divided into a first fraction consisting predominantly of particles having an equivalent spherical diameter larger than 1 μm, and a second fraction consisting predominantly of particles having an equivalent spherical diameter smaller than 1 μm, the average aspect ratio of the first fraction is greater than 25 and the average aspect ratio of the second fraction is greater than 25.

In a preferred embodiment of the second aspect of the present invention, the paper coating pigment has the following characteristics:

a particle size distribution such that at least 45% by weight of the particles have an equivalent spherical diameter smaller than 2 μm; and a distribution of particle aspect ratios such that each of the following size fractions of the pigment:

≦0.5 μm

>0.5 μm to 1.0 μm

>1.0 μm to 2.0 μm

>2.0 μm to 5.0 μm

>5.0 μm to 10.0 μm

>10.0 μm and which also contains an appreciable proportion of the particles of the pigment has an average aspect ratio of 25 or more.

In another preferred embodiment of the second aspect of the present invention, the paper coating pigment has the following characteristics:

a particle size distribution such that at least 45% by weight of the particles have an equivalent spherical diameter smaller than 2 μm; and a distribution of particle aspect ratios such that any size fraction of the pigment containing an appreciable proportion of the particles of the pigment has an average aspect ratio of 25 or more.

By a "size fraction", we mean a fraction of the pigment in which the equivalent spherical diameters of the particles in that fraction predominantly lie within a range defined by respective upper and lower limits. For example, the "less than 0.5 μm size fraction" predominantly contains particles the equivalent spherical diameters of which are less than 0.5 μm; likewise, the "1 μm to 2 μm size fraction" predominantly contains particles the equivalent spherical diameters of which are within the range of from 1 μm to 2 μm.

As will be appreciated, in the paper coating pigment art, it may not be practically possible to isolate a fraction (which will normally be done by a sedimentation technique) in which 100% of the particles are within a particular size range. The techniques available do, however, enable fractions to be isolated in which the vast majority of particles are within the desired range and we therefore refer herein to a "fraction" in which the equivalent spherical diameters of the particles in that fraction "predominantly" lie within a particular size range. By "predominantly" in this context, we mean that at least 90% of the particles in the fraction lie within the respective range.

As stated above, the "size fraction" of the pigment must contain an appreciable proportion of the particles of the pigment. In the paper coating pigment art, it will be appreciated that, from a theoretical point of view, smaller and smaller (in quantity) fractions can be isolated, containing fewer and fewer particles. Very small fractions of a pigment containing very few particles will tend not to have a significant effect on the properties of a paper coating composition prepared from the bulk pigment. It is believed that size fractions containing more than 10% by weight of the particles of the bulk pigment, and preferably more than 5% by weight of the particles of the bulk pigment should be considered when determining the distribution of particle aspect ratios; in other words, the distribution of particle aspect ratios of the pigment of the first aspect of this invention should preferably be such that any size fraction of the pigment containing at least 10% of the particles of the pigment has an average aspect ratio of 25 or more, and more preferably should be such that any size fraction of the pigment containing at least 5% of the particles of the pigment has an average aspect ratio of 25 or more.

When a pigment as described above, having a high average aspect ratio both above and below 1 μm esd, and preferably throughout the entire size range, is used in a paper coating composition, it is found that it is possible to achieve relatively high coat weights (for example at least 7 $gm^{-2}$ at relatively high web speeds (for example at least 1000 $m.min^{-1}$, preferably at least 1400 $m.min^{-1}$) and relatively high solids concentrations without having to operate at excessively high or low blade pressures and without the formation of stalagmites. In such a high speed paper coating method, the paper coating composition comprising a high solids aqueous suspension of a paper coating pigment may be applied in a manner known per se by a blade to the surface of a paper web.

In accordance with another aspect of the present invention, there is provided a paper coating composition comprising an aqueous suspension of a paper coating pigment in accordance with the first or second aspect of the present invention and an adhesive.

In accordance with a further aspect of the present invention, there is provided the use of a paper coating composition in accordance with the present invention in a paper coating method for the purpose of enhancing water retention of the composition.

In accordance with a still further aspect of the present invention, there is provided the use of a paper coating composition in accordance with the present invention for the purpose of improving the high speed runnability in a paper coating method in which the paper coating composition is applied by a blade moving relative to the paper web at a predetermined speed.

The paper coating composition of the present invention may comprise as little as 10% by weight (or even less) of the pigment in some of the more exotic coating methods; however, for the most commonly used coating methods, the composition will contain in the range of from 40 to 70% by weight of the pigment. The precise value will, of course, depend upon the pigment used, the coating method employed, the speed of the web through the coating machine and other factors known to the skilled person.

The adhesive used in the paper coating composition will normally be of the latex variety or contain a significant proportion thereof and should preferably be of the non-thickening (or non-alkali swelling) variety, for example a styrene-butadiene latex or a mixture of the two types of latex in any proportion. The amount of latex employed will normally be in the range of from 4 to 18 parts by weight to every 100 parts by weight of the inorganic material.

In making up a paper coating composition of the present invention, the latex and the pigment are first prepared as dispersed suspensions. The respective dispersants should be chosen such that the pigment dispersion remains stable in the presence of the latex. The dispersant for the pigment may conveniently be a water soluble salt of a poly (acrylic acid) or of a poly (methacrylic acid) having a number average molecular weight of less than 10,000 and preferably in the range from 1,000 to 5,000. The amount of the dispersant used is in the range from 0.05% to 5.0% by weight, based on the weight of dry pigment. Preferably the amount is in the range from 0.2% to 0.5% by weight, based on the weight of dry pigment.

In accordance with a yet further aspect of the present invention, there is provided a method for enhancing the water retention and/or improving the high speed runnability of a paper coating composition in a paper coating method which comprises the step of increasing substantially the average aspect ratio of the size fraction of the paper coating pigment smaller than 1 μm.

In this aspect of the invention, the average aspect ratio of the size fraction of the paper coating pigment smaller than 1 μm may be increased by incorporating in the pigment a proportion (preferably at least 10% by weight) of a paper coating pigment having a particle size distribution such that at least 75% by weight of the particles have an equivalent spherical diameter smaller than 2 μm and at least 60% by weight have an equivalent spherical diameter smaller than 1 μm, the average particle aspect ratio of the size fraction having an equivalent spherical diameter predominantly smaller than 1 μm being 25 or greater. The amount incorporated may be such as to increase the average aspect ratio of the size fraction smaller than 1 μm of the whole pigment to at least 25.

For the purposes of this application, the aspect ratio of a particle is defined as the ratio of the diameter of a circle which has the same area as that of the largest face of a particle to the smallest dimension of the particle, normally the thickness. A measure of the average aspect ratio of a particulate material may conveniently be obtained using an electron microscope employing the shadowing technique described in "Techniques for Electron Microscopy" edited by Desmond H. Kay, Blackwell Scientific Publications Limited, Oxford, 1968, pages 136 to 144.

The invention will now be described, by reference to the following examples.

EXAMPLE 1

Three paper coating compositions of the type suitable for preparing coated paper suitable for offset printing were prepared according to the following formula:

100 parts by weight of pigment 11 parts by weight of styrene-butadiene latex adhesive sodium hydroxide to give a pH of 8.5 water to give an initial solids concentration of 65% by weight

Three different pigments A,B and C were used:

Pigment A was a conventional kaolin clay product suitable for use as a paper coating pigment. The particle size distribution of the product was such that 80% by weight consisted of particles having an equivalent spherical diameter smaller than 2 μm and 65% by weight consisted of particles having an equivalent spherical diameter smaller than 1 μm. The average aspect ratio of the particles of a first fraction consisting of particles having an equivalent spherical diameter larger than 1 μm was 20, and the average aspect ratio of a second fraction consisting predominantly of particles having an equivalent spherical diameter smaller than 1 μm was 40.

Pigment B was a conventional kaolin clay product which had a particle size distribution such that 80% by weight consisted of particles having an equivalent spherical diameter smaller than 2 μm and 65% by weight consisted of particles having an equivalent spherical diameter smaller than 1 μm. The average aspect ratio of the particles of a first fraction consisting of particles having an equivalent spherical diameter larger than 1 μm was 45, and the average aspect ratio of a second fraction consisting predominantly of particles having an equivalent spherical diameter smaller than 1 μm was 15.

Pigment C was a pigment in accordance with the invention and consisted of 40% by weight of a kaolin clay having a particle size distribution such that 95% by weight consisted of particles having an equivalent spherical diameter smaller than 2 μm and 80% by weight consisted of particles having an equivalent spherical diameter smaller than 1 μm and 60% by weight of a kaolin clay having a particle size distribution such that 80% by weight consisted of particles having an equivalent spherical diameter smaller than 2 μm and 65% by weight consisted of particles having an equivalent spherical diameter smaller than 1 μm. The particles of the mixed pigment had an aspect ratio distribution such that the average aspect ratio of the particles of a first fraction consisting of particles having an equivalent spherical diameter larger than 1 μm was 40, and the average aspect ratio of a second fraction consisting predominantly of particles having an equivalent spherical diameter smaller than 1 μm was 35.

Each composition was coated on to an offset printing base paper of weight 40 $g.m^{-2}$ by means of a laboratory coating machine of the type described in British Patent Specification No. 2224673 fitted with a short-dwell coating head with a blade angle of 45° and at a paper speed of $1400m.min^{-1}$.

Samples of coated paper were prepared using each coating composition at a series of dilutions for a fixed blade pressure to give a range of different coat weights. The highest coat weight which could be achieved for each composition without any build-up of composition on the downstream edge of the blade, deposition of coating defects such as streaks or scratches was recorded. This observation may be regarded as a measure of the "runnability" of the composition.

Each sample of coated paper was also tested for sheet gloss, offset print gloss and sheet brightness and the value of each of these properties was plotted graphically against coat weight for each of the three compositions. The value of the property which corresponded to a coat weight of 8 $g.m^{-2}$ was found by interpolation.

The measurements of sheet gloss were performed according to TAPPI Standard No. T480ts-65 using a Hunterlab D16 gloss meter at an angle of incidence and measurement of 75° with the normal to the paper.

The brightness measurements were performed according to I.S.O. Standard No. 2470 using an Elrepho brightness meter fitted with a filter giving light of wavelength 457 nm.

The measurements of print gloss were made by printing strips of the coated paper samples with approximately 1 $g.m^{-2}$ of a magenta ink on an IGT print tester to give a solid block of colour. The gloss of the printed area was measured according to TAPPI Standard No. T480ts-65 using the Hunterlab D16 gloss meter at an angle of incidence and measurement of 75° with the normal to the paper.

The results are set forth in Table 1 below.

TABLE 1

| Composition | Sheet gloss (TAPPI units) | Sheet brightness (%) | Print gloss (TAPPI units) | Maximum coat weight ($g.m^{-2}$) |
|---|---|---|---|---|
| A | 59 | 69.4 | 75 | 7.5 |
| B | 66 | 70.0 | 75 | 5.5 |
| C | 70 | 69.6 | 80 | 9.0 |

These results show that the pigment in accordance with the invention, Pigment C, makes it possible to prepare a coated paper which is superior in both sheet gloss and print gloss and which has equivalent brightness, when compared with the results obtained with the coated papers prepared using compositions containing the two conventional pigments. Furthermore, the coating composition containing Pigment C can be applied at a higher coat weight at a paper speed of 1400 $m.min^{-1}$ and at a blade pressure of 1.2 bar, and therefore shows superior "runnability" to that exhibited by the two compositions containing the conventional pigments.

EXAMPLE 2

Four further paper coating compositions were prepared from various pigment blends according to the following formula:

100 parts pigment blend;

11 parts styrene butadiene offset latex, particle size 0.185 micron;

0.5 parts CMC (degree of substitution 0.7, molecular weight 34000);

water to high solids content.

The base pigments employed were as follows:

Pigment X—A kaolin clay with 80% by weight of the particles below 2 μm and 65% by weight below 1 μm and an average aspect ratio in the less than 1 μm fraction of 40.

Pigment Y—A ground calcium carbonate with 90% by weight of the particles below 2 μm and 65% by weight below 1 μm (and an average aspect ratio of 5 throughout the size range).

Pigment Z—A kaolin clay with 93% (by weight) of the particles below 2 μm and 75% (by weight) below 1 μm and an average aspect ratio in the less than 1 μm fraction of 15.

The following four pigment blends were prepared:

20% Pigment Y:80% Pigment Z

40% Pigment Y:60% Pigment Z

15% Pigment Y:85% Pigment X

30% Pigment Y:70% Pigment X

Runnability experiments were carried out on a pilot scale paper coating machine at a speed of 1200 m/min using a short dwell coater, with targeted coat weights of 6,8 and 10 $gm^{-2}$. A commercial LWC offset base was used with a substance of 40 $gm^{-2}$, and the paper coating compositions used were as described above based on the four pigment blends referred to above.

The method for measuring blade coater runnability employed was as described in "High Speed Runnability of Blade Coaters", Paper Technology, April 1992. In this method, the coater is run at a constant speed (e.g. 1200 m/min), and three coat weights are selected to span the range of interest. The coating colour is introduced at a high solids content, and the blade pressure is varied to attain each of the three coat weights required. At each coat weight/blade pressure, the condition of the blade and coating surface was noted (bleeding or no bleeding, stalagmite formation and coating deposition). The coating colour is then diluted in steps such that the colour solids is reduced by approximately 0.5 to 1 weight percent at each dilution. After each dilution, the blade pressures required to attain each of the desired coat weights are noted, as is the condition of the blade. This process is continued until the colour solids is so low that blade pressures are excessively low (such that coat weight profile control is poor) for all three coat weights.

Hence, from such an experiment, a range of colour solids (the "runnability window") can be defined within which good coatings can be obtained at a given coat weight. The upper end of the range or "runnability window" is defined by the solids at which blade bleeding, stalagmite formation and coating deposition becomes manifest. The lower end of the range is defined by the solids at which good coat weight profile control is no longer attained because blade pressure is very low.

Thus, "good runnability" refers to the situation in which the solids range or "runnability window" is large. "Poor runnability" refers to the situation in which the "runnability window" is small or non-existent. This last case arises when the elimination of blade bleeding (and stalagmite formation and coating deposition), requires that solids be reduced to the point where, for a given coat weight, blade pressure is so low that poor coat weight profile control is obtained.

The runnability windows (given in weight percent solids), obtained with the various pigment blends employed are set out in Table 2 below.

TABLE 2

| | Coat weight | | |
|---|---|---|---|
| Pigment blend | 6 gsm | 8 gsm | 10 gsm |
| 20Y:80Z | 0 | 0 | 0 |
| 40Y:60Z | 0 | 0 | 0 |
| 15Y:85X | 3.8 | 5.1 | 4.9 |
| 30Y:70X | 2.5 | 3.0 | 2.0 |

We claim:

1. A paper coating pigment having:

a particle size distribution such that at least 45% by weight of the particles have an equivalent spherical diameter smaller than 2 μm; and a distribution of particle aspect ratios such that if the pigment is subjected to a particle size separation such that the pigment is divided into a first fraction consisting predominantly of particles having an equivalent spherical diameter larger than 1 μm, and a second fraction consisting predominantly of particles having an equivalent spherical diameter smaller than 1 μm, the average aspect ratio of the first fraction is greater than 25 and the average aspect ratio of the second fraction is greater than 25.

2. A paper coating pigment according to claim 1, wherein the pigment is a kaolinitic clay.

3. A paper coating pigment according to claim 1, which has the following characteristics:

a particle size distribution such that at least 45% by weight of the particles have an equivalent spherical diameter smaller than 2 μm; and a distribution of particle aspect ratios such that any size fraction of the pigment containing an appreciable proportion of the particles of the pigment has an average aspect ratio of 25 or more.

4. A paper coating pigment according to claim 3, wherein the pigment is a kaolinitic clay.

5. A paper coating pigment according to claim 1, which has:

a distribution of particle aspect ratios such that each of the following size fractions of the pigment:

≦0.5 μm

>0.5 μm to 1.0 μm

>1.0 μm to 2.0 μm

>2.0 μm to 5.0 μm

>5.0 μm to 10.0 μm

>10.0 μm which also contains an appreciable proportion of the particles of the pigment has an average aspect ratio of 25 or more.

6. A paper coating pigment according to claim 5, wherein the pigment is a kaolinitic clay.

7. A paper coating pigment according to claim 1, wherein the pigment comprises a mixture of at least two pigments, as follows:

(a) at least 10% by weight of a first paper coating pigment having a particle size distribution such that at least 75% by weight of the particles have an equivalent spherical diameter smaller than 2 μm and at least 60% by weight have an equivalent spherical diameter smaller than 1 μm, the average particle aspect ratio of the size fraction having an equivalent spherical diameter predominantly smaller than 1 μm being 25 or greater; and (b) up to 90% by weight of a second paper coating pigment.

8. A paper coating pigment according to claim 7, wherein the average particle aspect ratio of the size fraction of the first paper coating pigment having an equivalent spherical diameter predominantly smaller than 1 μm is 30 or greater.

9. A paper coating pigment according to claim 7, wherein the average particle aspect ratio of the size fraction of the first paper coating pigment having an equivalent spherical diameter predominantly smaller than 1 μm is 40 or greater.

10. A paper coating pigment according to claim 7, wherein the first paper coating pigment constitutes at least 20% by weight of the total pigment.

11. A paper coating pigment according to claim 7, wherein the first paper coating pigment constitutes at least 40% by weight of the total pigment.

12. A paper coating pigment according to claim 7, wherein the first paper coating pigment comprises a kaolinitic clay.

13. A paper coating pigment according to claim 7, wherein the second paper coating pigment is a kaolinitic clay.

14. A paper coating composition comprising (i) an aqueous suspension of a paper coating pigment which pigment has a particle size distribution such that at least 45% by weight of the particles have an equivalent spherical diameter smaller than 2 μm, and which has a distribution of particle aspect ratios such that if the pigment is subjected to a particle size separation such that the pigment is divided into a first fraction consisting predominantly of particles having an equivalent spherical diameter larger than 1 μm, and a second fraction consisting predominantly of particles having an equivalent spherical diameter smaller than 1 μm, the average aspect ratio of the first fraction is greater than 25 and the average aspect ratio of the second fraction is greater than 25; and (ii) an adhesive.

15. A paper coating method in which a paper coating composition according to claim 14 is coated onto the surface of a paper.

16. A paper coating composition according to claim 14, wherein the pigment comprises a mixture of at least two pigments as follows:

(a) at least 10% by weight of a first paper coating pigment having a particle size distribution such that at least 75% by weight of the particles have an equivalent spherical diameter smaller than 2 μm and at least 60% by weight have an equivalent spherical diameter smaller than 1 μm, the average particle aspect ratio of the size fraction having an equivalent spherical diameter predominantly smaller than 1 μm being 25 or greater; and (b) up to 90% by weight of a second paper coating pigment.

17. A paper coating method in which a paper coating composition according to claim 16 is coated onto the surface of a paper.

* * * * *